US005214905A

United States Patent [19]

Wyberg

[11] Patent Number: 5,214,905

[45] Date of Patent: Jun. 1, 1993

[54] METHOD AND APPARATUS FOR SEALING A GABLE-TOP CONTAINER

[75] Inventor: Gregory R. Wyberg, Minneapolis, Minn.

[73] Assignee: Minnesota Mining and Manufacturing Company, St. Paul, Minn.

[21] Appl. No.: 759,459

[22] Filed: Sep. 13, 1991

[51] Int. Cl.[5] ..... B65B 51/14

[52] U.S. Cl. ..... 53/477; 53/484; 493/184

[58] Field of Search ..... 53/477, 484, 370.7, 53/370.2; 493/165, 184, 133; 219/245, 243

[56] References Cited

U.S. PATENT DOCUMENTS

| | | | |
|---|---|---|---|
| 2,750,095 | 6/1956 | Alden | 229/17 |
| 3,120,089 | 2/1964 | Monroe et al. | 53/86 |
| 3,200,557 | 8/1965 | Schwenk | 53/477 |
| 3,245,603 | 4/1966 | Wilcox | 229/17 |
| 3,292,842 | 12/1966 | Huang et al. | 229/17 |
| 3,956,046 | 5/1976 | Tsuchiya et al. | 53/477 X |
| 4,159,220 | 6/1979 | Bosche et al. | 156/73.1 |
| 4,251,303 | 2/1981 | Deimel et al. | 156/73.1 |
| 4,403,465 | 9/1983 | Bachner | 53/477 |
| 4,518,377 | 5/1985 | Skinner | 493/58 |
| 4,586,643 | 5/1986 | Halabisky et al. | 229/3.1 |
| 4,712,727 | 12/1987 | Wyberg | 206/631.3 |
| 4,756,426 | 7/1988 | Wyberg | 206/631.3 |
| 4,762,234 | 8/1988 | Wyberg | 206/631.3 |
| 4,792,048 | 12/1988 | Wyberg | 206/631.3 |
| 4,813,547 | 3/1989 | Wyberg | 206/631.3 |
| 4,813,548 | 3/1989 | Wyberg | 206/631.3 |
| 4,860,902 | 8/1989 | Kieser | 53/477 X |
| 4,869,372 | 9/1989 | Wyberg | 206/631.3 |
| 4,869,373 | 9/1989 | Wyberg | 206/631.3 |
| 4,872,562 | 10/1989 | Wyberg | 206/631.3 |
| 4,946,041 | 8/1990 | Poole | 236/621.1 |
| 5,083,702 | 1/1992 | Wyberg | 229/125.42 |

FOREIGN PATENT DOCUMENTS

| | | | |
|---|---|---|---|
| 28941 | 5/1981 | European Pat. Off. | 53/370.7 |
| 75/6322 | 10/1975 | South Africa . | |

*Primary Examiner*—James F. Coan

*Attorney, Agent, or Firm*—Gary L. Griswold; Walter N. Kirn; Peter L. Olson

[57] ABSTRACT

A method and apparatus are provided for sealing a gable-top container to allow easier opening, as well as the carton sealed by the method provided When the container is sealed, a portion of at least one sealing jaw is recessed to prevent functional impairment of the underlying pouring spout tips.

4 Claims, 4 Drawing Sheets

METHOD AND APPARATUS FOR SEALING A GABLE-TOP CONTAINER

TECHNICAL FIELD

This invention relates to packaging, and particularly to a method and apparatus for constructing a gable-top container having improved opening characteristics.

BACKGROUND OF THE INVENTION

Containers for beverages such as milk, fruit juices, and drinks are conventionally constructed from blanks of thermoplastic coated paperboard. The most widely used of such containers have a rectangular cross-sectional body surmounted by a gable-top closure incorporating an extensible pouring spout. Blanks from which the containers are constructed are divided into a plurality of panels that are adapted to form the walls and closure members. The panels are formed and separated by score lines at which the blank is folded. Particular panels are intended to be joined together in a lapped arrangement in the completed container. Typically those panels are pressed together and heated, or exposed to high frequency radiation to fuse the adjoining thermoplastic surfaces and form a seal. To seal the top of a filled container, two or more panels are joined and sealed to form a rib along the top edge of the roof panels. Exemplary of such container blanks are those shown in U.S. Pat. Nos. 2,750,095 (Alden) and 3,245,603 (Wilcox).

Most gable-top containers have certain characteristics in common. Four side panels are connected together along their respective longitudinal edges, and a set of bottom closure panels cooperate to seal the bottom of the container. The top of the container consists of two roof panels and two triangular end panels, each of which is connected to the top edges of the side panels. Other pouring spout panels connect the roof panels and the triangular end panels, and include first and second foldback panels and first and second roof wing panels. Attached to the uppermost edge of each of the roof panels is a roof rib panel, and an upper rib panel is connected to the uppermost edge of each roof rib panel. A gable rib panel is connected to the upper edge of each of the first and second foldback panels, and the center of the gable rib panel typically forms a pouring spout tip. The pouring spout panels, which comprise at least the triangular end panel, the first and second foldback panels, and the first and second roof wing panels, are adapted to shift between a closed position and an open position. When in the closed position, the gable rib panel is located between the roof rib panels, and is sealed thereto during the sealing process. When in the open position, the pouring spout panels are extended to allow dispensation of the contents of the container. It should be noted that most gable-top containers comprise two pouring spouts, although only one is typically used for dispensing the contents of the container.

Containers of this type are opened for access to the contents by a two step toggle action process. First, the edges of the roof panels at the front of the container are pushed outward and upward toward the rear of the container by thumb pressure, breaking the seal in the roof rib and upper rib panels surmounting the roof above the pouring spout. This will be referred to as foldback, or Stage I opening. Second, the edges of the roof panels are pushed forward and toward each other. The forces are communicated through spout panels to the tip of the pouring spout, breaking the seal between the gable rib panels and the underside of the roof rib panels and snapping the spout outward to a pouring position. This will be referred to as extension, or Stage II opening. For purposes of this invention, Stage II opening forces are the more critical, because the seal at and near the pouring spout tip is completely separated during Stage II opening It is difficult to form consistently a gable-top container that is both adequately sealed and easy to open. The difficulty is due in large measure to the circumstances attendant the sealing of the container. When the pouring spout is folded into a closed position, the container panels comprising the edge of the pouring spout are directly adjacent each other, resulting in an area of double thickness cardstock. However, in the area proximate the tip of the pouring spout, the cardstock has been deformed by buckling and its thickness is greater than a double thickness of cardstock. For example, in a conventional gable-top container with the spout in a closed condition, the area of double thickness cardstock adjacent the pouring spout tip has been measured at 0.050" thick. The pouring spout tip itself has been measured at 0.071" thick, an increase of 42% due to buckling in the tip region.

When conventional sealing means are applied to the upper panels of the carton, planar sealing jaws apply a force against the roof rib and upper rib panels that is equally distributed over the area of each jaw. However, because the area proximate the pouring spout tips is thicker than the remainder of the roof rib and upper rib panels, the application of sealing force results in higher pressure in the area surrounding the pouring spout tips. The result is a pinching action in the area proximate the pouring spout tips, which renders the carton more difficult to open. Furthermore, the increased thickness in the center of the carton top is compressed during sealing, and when the sealing pressure is released the panels have a tendency to spring back into position, which pulls the seal apart. This problem is particularly prevalent in cartons incorporating a stiffening fillet on one or more of the pouring spout panels, as shown in U.S. Pat. Nos. 4,726,234; 4,813,548; 4,872,562; 4,756,426; 4,792,048; 4,869,372; 4,712,727; 4,813,547; and 4,869,373.

One possible solution to the problem presented would be to reduce the overall force applied to the sealing jaws. While this would certainly reduce the pressure in the area proximate the pouring spout tips, the pressure reduction would compromise seal integrity in the remainder of the upper panels. Abhesives have found some application in gable-top container sealing, and the pouring spout tips could also be coated with such an abhesive to prevent or reduce effective sealing in designated areas. However, abhesives are typically very temperature sensitive, and because sealing temperatures cannot always be accurately controlled, abhesives are also an unacceptable solution.

Thus, it is desirable to provide a gable-top container having a reduced opening force, while not allowing carton spring back to separate the seal, or damaging the pouring spout in any way. This problem is not adequately solved by any of the conventional gable-top container designs, and in particular with gable-top container constructed from higher strength laminates.

SUMMARY OF THE INVENTION

The present invention includes a method for producing a gable-top container, comprising the steps of providing a container blank adapted to form the gable-top container having an inner and an outer surface, said inner surface having a coating of thermoplastic. The container comprises at least one wall, a bottom and a top, at least one set of pouring spout panels comprising a first generally triangular end panel, first and second foldback panels, and first and second roof wing panels, which cooperate to form a pouring spout. The pouring spout is adapted for movement between a retracted position and an extended position, and when in the extended position, the spout allows dispensation of the contents of the container.

The gable-top container also includes first and second roof panels. The first roof panel is connected to an uppermost edge of the at least one wall and adjoins the first roof wing panel along one lateral edge thereof. The second roof panel is connected to an uppermost edge of the at least one wall and adjoins the second roof wing panel along one lateral edge thereof.

Also included are first and second gable rib panels. The first gable rib panel is connected to an upper edge of the first foldback panel, and the second gable rib panel is connected to an upper edge of said second foldback panel. A common scoreline between the first and second gable rib panels directly above a peak of said generally triangular end panel forms a pouring spout tip. First and second roof rib panels are also provided. The first roof rib panel is connected to the first roof panel and the first roof wing panel. The second roof rib panel is connected to the second roof panel and the second roof wing panel, and the first and second roof rib panels are adapted to seal against the first and second gable rib panels located therebetween when the pouring spout is in the retracted position.

Finally, first and second upper rib panels are also provided. The first upper rib panel is connected to the uppermost edge of the first roof rib panel and extends upwardly therefrom, and the second upper rib panel is connected to the uppermost edge of the second roof rib panel and extends upwardly therefrom. The upper rib panels are adapted for reciprocal bonding to seal the container.

The gable-top container is formed from the container blank, and the pouring spout is adapted to maintain the pouring spout tip between the first and second roof rib panels when the pouring spout is in the retracted position. After formation, the inner surface of said roof rib panels and said upper rib panels is heated to a temperature sufficient to seal the container.

Upon attainment of the necessary temperature, a first sealing pressure is applied to the upper rib panels and to first portions of the roof rib panels to seal the container. A second sealing pressure is applied to second portions of the roof rib panels overlying at least one pouring spout tip to seal the inner surfaces of the second portions of the roof rib panels against the gable rib panels located therebetween. The first and second sealing pressures bring the upper rib panels and the roof rib panels into mutual contact so as to permit reciprocal bonding thereof to seal the container without functionally impairing the pouring spout tip or tips. The present invention also includes within its scope the gable-top carton formed by the method described above, as well as the method described above when used on a carton having two pouring spout tips in opposed relationship. Also included is apparatus for sealing a gable-top carton in accordance with the present invention.

BRIEF DESCRIPTION OF THE DRAWINGS

The present invention will be further described with reference to the accompanying drawings, wherein.

DETAILED DESCRIPTION

Figure 1:
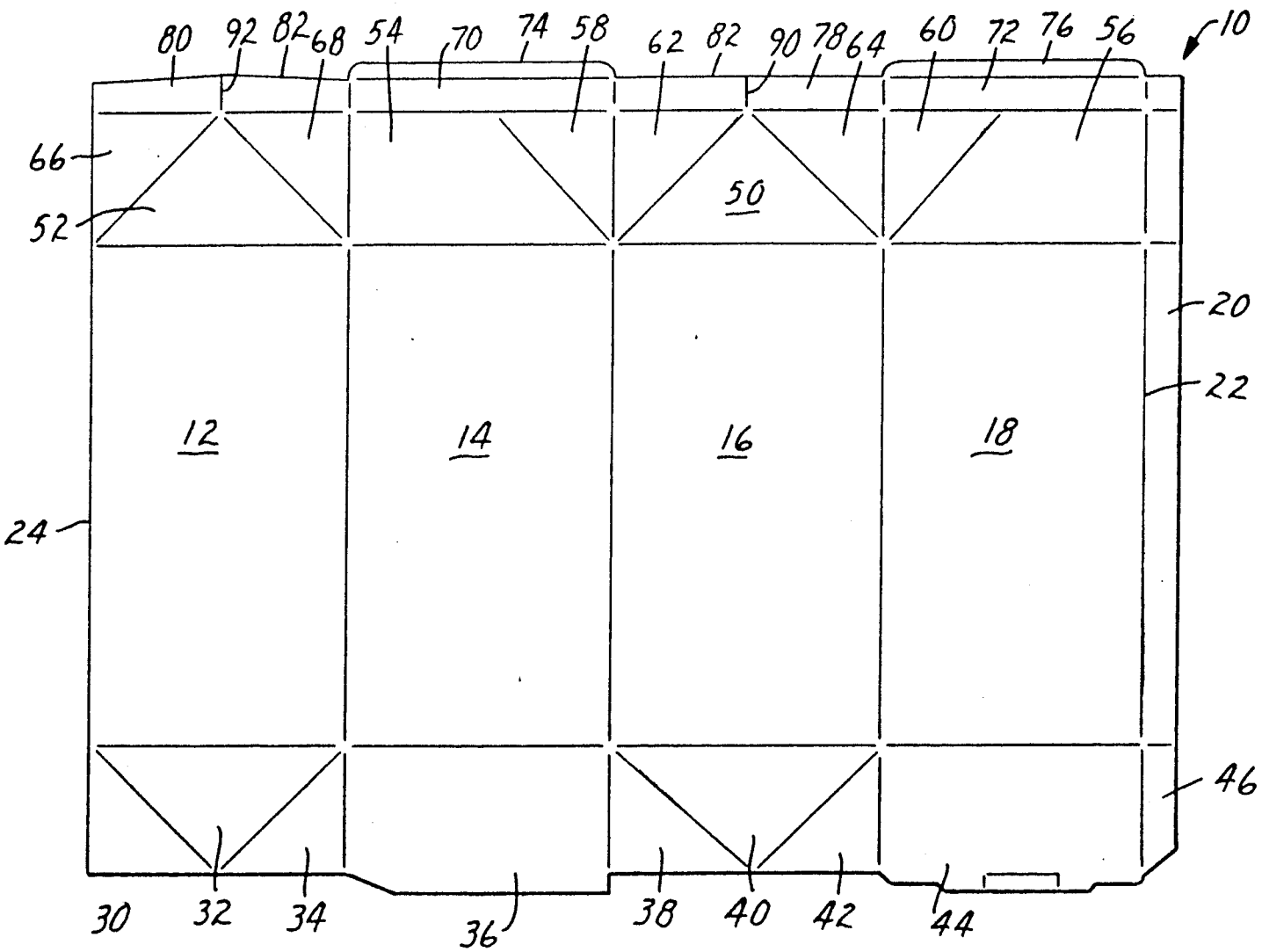
FIG. 1 is a plan view of the container blank of the present invention.

Referring now to the drawings, a gable-top container with reduced opening force is depicted. FIG. 1 shows a representative gable-top container blank 10, wherein side panels 12, 14, 16, and 18 are connected along their respective longitudinal edges. Closure panel 20 is connected to a longitudinal edge 22 of side panel 18, and is sealed to longitudinal edge 24 of side panel 12 when the gable-top container is assembled. Bottom closure panels 30–46 engage and seal to close the bottom of the container.

First and second triangular end panels 50 and 52 are also shown. First triangular end panel is connected to the uppermost edge of side panels 16, and second triangular end panel is connected to the uppermost edge of side panel 12. First and second roof panels 54 and 56 are connected to the uppermost edges of side panels 14 and 18. When the container is closed for sealing, roof panels 54 and 56 converge upwardly to form a gable roof construction. When roof panels 54 and 56 are closed to form the roof of the container, triangular end panels 50 and 52 are folded under the gable roof formed by roof panels 54 and 56.

Also shown are first and second roof wing panels 58 and 60. The roof wing panels are subpanels of roof panels 54 and 56, respectively. First and second foldback panels 62 and 64 are each connected along one edge to first triangular end panel 50. First foldback panel 62 is also connected along a second edge to first roof wing panel 58, and second foldback panel 64 is connected to second roof wing panel 60. Third and fourth foldback panels 66 and 68 are similarly connected to second triangular end panel 52 along one edge thereof. Fourth foldback panel 68 is connected to first roof panel 54. Third foldback panel 66 is adapted to seal against closure panel 20 when the container is in a closed condition. For purposes of this invention, the term "pouring spout panels" shall be understood to include at least a generally triangular end panel, first and second foldback panels, and first and second roof wing panels, connected together in the manner just described to form a pouring spout.

First and second roof rib panels 70 and 72 are also provided. First roof rib panel 70 is connected to the uppermost edges of first roof panel 54 and second roof wing panel 58, and extends upwardly therefrom. Second roof rib panel 72 is connected to the uppermost edges of second roof panel 56 and first roof wing panel 60, and extends upwardly therefrom. First gable rib panel 78 is connected to first and second foldback panels 62 and 64, and extends upwardly therefrom, serving as the lips of the pouring spout when the spout is in an extended position. Second gable rib panel 80 is connected to third and fourth foldback panels 66 and 68, and extends upwardly therefrom. First and second upper rib panels 74 and 76 extend upwardly from the first and second roof rib panels 70 and 72 to a level higher than the free upper edges 82 of gable rib panels 78 and 80. Pouring spout tips 90 and 92 are located approximately at a longitudinal midpoint of gable rib panels 78 and 80, respectively, and are in opposed relationship when the container is in a closed condition. The tips may contact each other, or may be spaced from each other, depending on the geometry of the carton.

The gabled roof is formed by pushing triangular end panels 50 and 52 inward and toward the bottom of the container. Roof panels 54 and 56 form the gable roof, and pouring spout tips 90 and 92 assume an opposed relationship between the roof rib panels. Pouring spout tips 90 and 92 may touch each other, or be spaced apart from each other when the container is in a closed or sealed condition. Upper rib panels 74 and 76 also oppose each other for reciprocal sealing thereof. Gable rib panels 78 and 80 are thus located between roof rib panels 70 and 72, and seal thereagainst.

The carton blank is formed into a carton by means known in the art, and therefore not shown. The panels forming the gable-top are then pre-formed substantially as shown in FIG. 2, again by means known in the art and therefore not shown. Pouring spout tips 90 and 92 are in opposed adjacent relationship, upper rib panels 74 and 76 are opposite each other and prepared for reciprocal sealing thereof. Gable rib panels 78 and 80 are located between roof rib panels 70 and 72 (not shown) for reciprocal sealing, as described immediately above.

Means are provided for heating the inner surface of the gable rib, roof rib, and upper rib panels to a temperature sufficient to permit reciprocal sealing thereof. Usually, such means takes the form of streams of hot air directed against the container to be sealed, as illustrated by blower 200 in FIG. 2.

Figure 2:
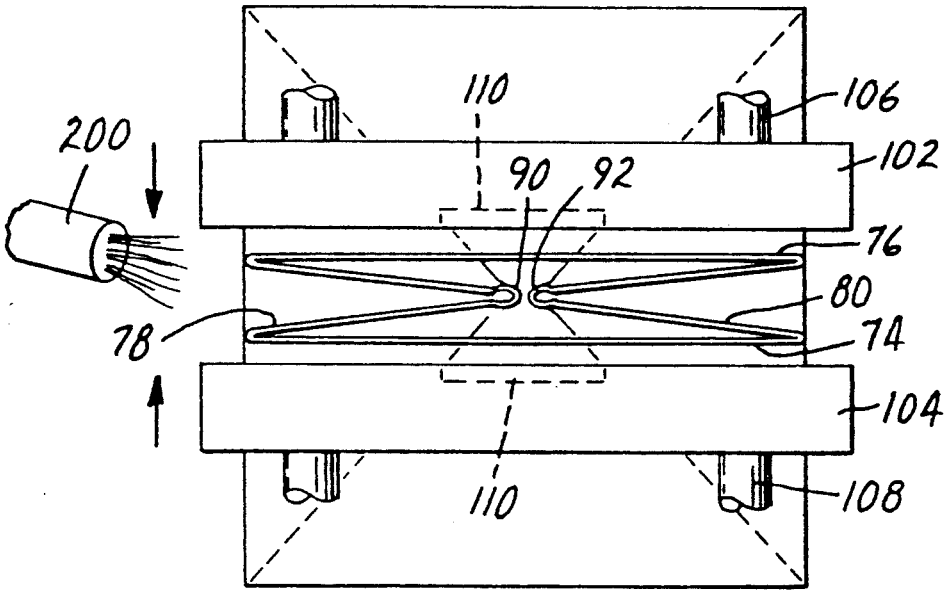
FIG. 2 is a top view of the gable-top container immediately prior to the sealing process of the present invention.

Means for sealing are also provided. In the illustrated embodiment, the means for sealing comprises a pair of opposed sealing jaws. Once the panels have been heated to the requisite temperature, the carton is positioned such that sealing jaws 102 and 104, shown in FIG. 2, may compress the upper panel structure. Also shown in FIG. 2 are means for cooperative movement 106 and 108, which are operatively connected to sealing jaws 102 and 104. The sealing jaws apply a first sealing force to predetermined areas of the roof rib panels and the upper rib panels, and a second pressure to predetermined areas of the roof rib panels in the area proximate the pouring spout tips without damage thereto. It should be understood that the second pressure may be less than, equal to, or greater than the first pressure, as long as the container is sealed and the pouring spout tips are not functionally impaired as a result. For example, if flat sealing jaws are used to seal the container, there will be higher pressure in the areas proximate the pouring spout tips, due to the greater thickness of the tips. The present invention provides for a first pressure to be applied to seal the carton, and a second pressure to be applied over the tips to seal the carton without functionally impairing the pouring spout tips. Thus, the pressure on the pouring spout tips may still be greater than that on the remainder of the upper rib and roof rib panels, so long as the tips are not functionally impaired. Similarly, the second pressure may be equal to, or less than the first pressure, depending on carton and sealing parameters.

Figure 3:
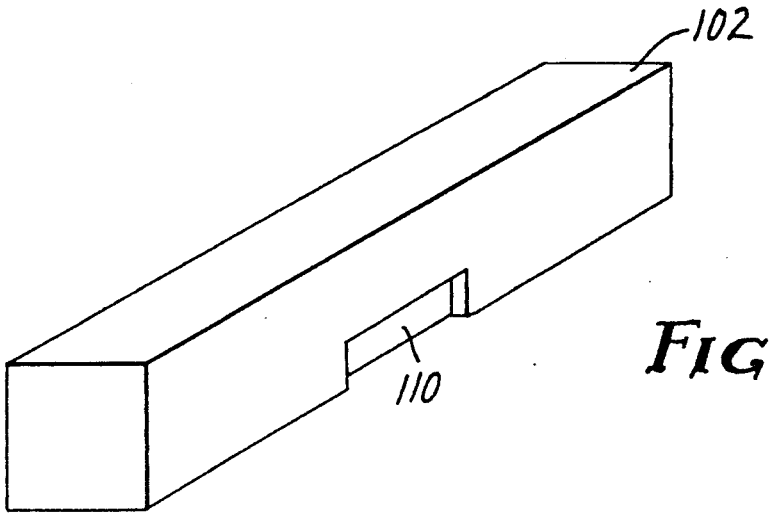
FIG. 3 is a perspective view of one embodiment of the sealing means of the present invention.

The preferred embodiment of the sealing jaws of the present invention is shown in FIG. 3. Sealing jaw 102 comprises a recess 110. Recess 110 is shown in the longitudinal center of jaw 102, but could also be offset toward either end in order to accommodate differing locations of pouring spout tips. Only one jaw is shown with recess 110, but in the preferred embodiment each of the two jaws comprises a recess, and the recesses are aligned. Such a recess may be of varying dimensions, so long as at least a portion of the recess aligns with the area proximate at least one of the pouring spout tips when the carton is being sealed. It is an advantage of the present invention that existing gable-top sealing machines may easily be modified to practice the present invention. Manufacturers of commercially available gable-top sealing machines that may be used in connection with the present invention include Cherry-Burelle of Louisville, Ky. and Pure-Pak of Walled Lake, Mich.

In the most preferred embodiment, the sealing jaws comprise a recess that is approximately centered over both of the pouring spout tips, and is approximately 0.02 inches deep, and either 0.3–0.4 inches wide (one quart container) or 0.5–0.6 inches wide (two liter container). The height of the recess depends on the application, but typically is adapted to match the height of the roof ribs—that is, the jaw applies a reduced sealing pressure within the area of the recess. The present invention includes within its scope a recess of any dimension or geometric configuration, including but not limited to a triangular or rectangular cross-sectional recess, that reduces or prevents functional impairment of the pouring spout tip or tips during sealing. For purposes of this invention, the term "functionally impairing" means physically damaging, displacing, pinching, or deforming a pouring spout tip, as well as sealing the container so as to prevent easy release of the pouring spout tip, from the adjoining panels during opening, or sealing the container such that the area proximate the pouring spout tips springs back after sealing to pull apart the seal.

In another embodiment thereof, the present invention is used with a gable-top container including the invention disclosed in co-pending application U.S. Ser. No. 497,437, filed Mar. 22, 1990, which is commonly assigned to the assignee of the present invention, and hereby expressly incorporated by reference herein. The invention disclosed therein relates to an easy opening gable-top container and a method for making the container, comprising means for inducing buckling in the upper rib portion of the sealed container, and can be used independent of the present invention. The means for inducing buckling employed in the examples below comprises a notch that is located adjacent the point where the pouring spout tips are positioned when the container is closed. When the carton is opened, the upper rib panels typically buckle, which adds to the force required to open the container. With the invention of the application Ser. No. 497,437, the buckling that is usually present in the upper rib area adjacent the pouring spout tips is attenuated due to the presence of the notch. As a result, the force necessary to open the carton is reduced. The following examples indicate test results both with and without the jaw relief of the present invention and the notch of the above-referenced invention, as noted in columns 2 and 3. It should be understood that the notch forms no part of the present invention, but does further lower the necessary opening force, and is therefore independently useful.

The following test results indicate the force necessary to open a gable-top container. Opening force is measured during Stage II of the two-step toggle action process (see supra). The first example is conducted using ordinary milk cartons, and the second with high strength cartons that employ a stiffening fillet, as is explained more fully below.

EXAMPLE ONE

One quart milk cartons manufactured by the International Paper Company of Raleigh, N.C., 27603, were sealed on a Liquipak Model 010 hand heat sealer, available from Liquipak International, of St. Paul, Minn. These cartons had an abhesive printed in the spout area, and were sealed at different temperatures. The relief for the pouring spout tips was 0.015" deep×0.3" wide. The height of the recess was equal to the height of the roof rib panel. In the cases where the notch was present (indicated by an "x" in column 3), the notch measured 0.25", and was located in the center of the carton, just above the area where the pouring spout tips meet. A gauge attached to each of the foldback panels measured the opening force during Stage II of the two-step toggle action process.

| Seal Temp. (°F.) | Relief | Notch | Opening Force (lbs.) |
|---|---|---|---|
| 290 | — | — | 6.0 |
| 290 | X | — | 4.6 |
| 290 | — | X | 3.5 |
| 290 | X | X | 3.6 |
| 320 | — | — | 9.2 |
| 320 | X | — | 8.5 |
| 320 | — | X | 6.5 |
| 320 | X | X | 5.4 |

Example one illustrates the benefit of the sealing means of the present invention. The required Stage II opening force decreased by 23% when the carton was sealed at 290°, and decreased by 8% when the carton was sealed at 320°.

EXAMPLE TWO

Tests were conducted on cartons having polymeric layers disposed thereon, as well as having a segment of reinforcing fillet located on the pouring spout tip, as disclosed in U.S. Pat. Nos. 4,726,234; 4,813,548; 4,872,562; 4,756,426; 4,792,048; 4,869,372; 4,712,727; 4,813,547; and 4,869,373. The reinforcing fillet of the referenced patents form no part of the present invention, but are independently useful, particularly with high strength cartons. Two liter cartons of the type disclosed in U.S. Pat. No. 4,787,507 were sealed using a Liquipak Model 010 hand carton sealer. The cartons had a 1"×2.5" piece of YR-8921 reinforcing fillet, constructed of unoriented polypropylene, on the inside of the pouring spout flush to the edge of the gable rib panel and extending downwardly therefrom. The referenced reinforcing fillet is available from the 3M Company of St. Paul, Minn. The tip relief in the sealing jaws was 0.5" wide ×0.02" deep. The height of the recess is equal to the height of the roof rib panel. Again, a gauge attached to the foldback panels measured the opening force during Stage II of the two-step toggle action process.

| Seal Temp. (°F.) | Relief | Notch | Opening Force (lbs.) |
|---|---|---|---|
| 300 | — | — | 8.7 |
| 300 | — | X | 4.6 |
| 300 | X | — | 4.2 |
| 300 | X | X | 4.3 |

Example 2 shows that the present invention alone reduces the force required for Stage II opening approximately 52% for cartons having a stiffening fillet and that were sealed at 300° F.

The test results presented in Examples One and Two were based on a small sample population—3 cartons per test, and the results varied widely. The average of those results is presented above. It should be noted that the test conducted at a sealing temperature of 320° on cartons without either a notch or jaw relief (and therefore representative of the prior art) was done with five containers. Two of the five containers did not open, and the results of the other three varied widely. Although the percentage decrease in opening force shown above is not as dramatic at higher temperatures, it is in part because some containers were unable to be opened. Thus, some conventional cartons, particularly those sealed at higher temperatures, have a tendency not to open due to abhesive breakdown adjacent the pouring spout tips.

Figure 4:
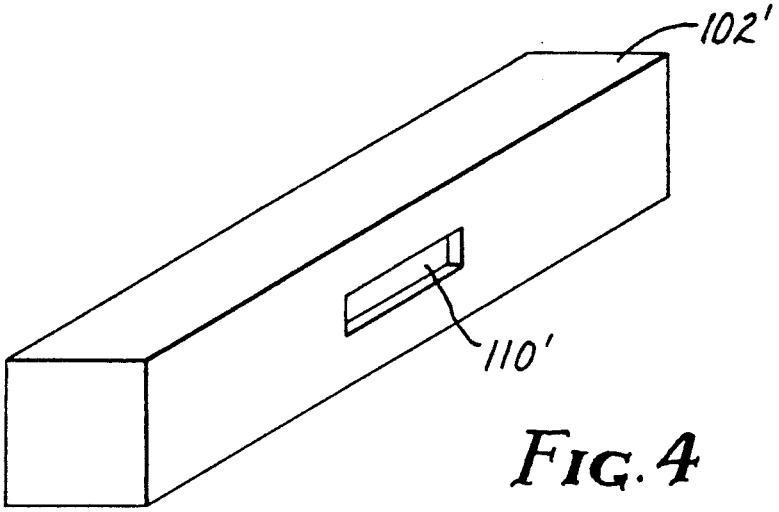
FIG. 4 is a perspective view of an alternate embodiment of the sealing means of the present invention.

FIG. 4 illustrates an alternate embodiment of the sealing means, shown here as sealing jaw 102'. Recess 110' is located in the center of jaw 102', and allows for sealing of the carton below recess 110', in the area of the roof ribs. In an alternate embodiment, recess 110 may also comprise a plurality of spaced recesses. For example, if the gable-top carton is rectangular, the first pouring spout tip may be spaced from the opposite pouring spout tip when each is in a closed position. In such a case, it might be advantageous to form spaced recesses in the face of each sealing jaw, in order that each pouring spout tip have less pressure applied to the area surrounding it. Alternatively, it might be advantageous to form recesses in the sealing jaws over only one of the pouring spout tips if the other spout were not intended to open. Clearly the location and dimensions of the recess or recesses of the illustrated embodiment depend on variables such as carton geometry and intended use, and such variations are intended to be within the scope of the present invention.

Figure 5:
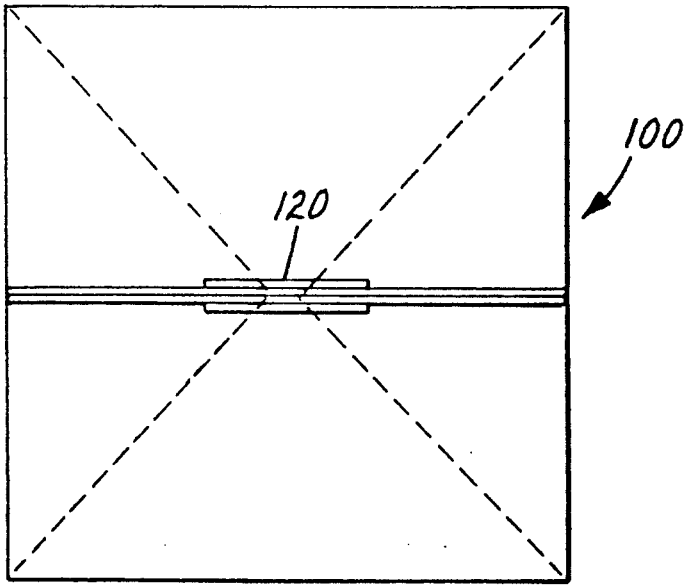
FIG. 5 is a top view of a gable-top container immediately after the sealing process of the present invention.

FIG. 5 illustrates gable-top container 100 in a sealed condition. The dimensions of medial zone 120 correspond to the dimensions of the recess in the jaws of the preferred embodiment of the invention. Medial zone 120 is located, in accordance with the preferred embodiment, above the area where pouring spout tips 90 and 92 (not shown) are located. The dimensions of medial zone 120 depend on the dimensions of the recess or recesses of the sealing jaws described above. Medial zone 120 could therefore be of many different dimensions and configurations, though only the medial zone corresponding with the preferred embodiment is shown in FIG. 5.

Figure 6:
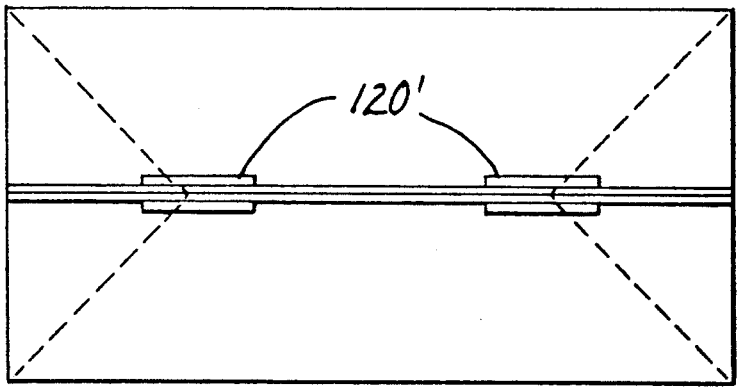
FIG. 6 is a top view of a gable-top container immediately after an alternate embodiment of the sealing process of the present invention.

FIG. 6 shows the top view of a gable-top container sealed according to an alternate embodiment of the present invention. Medial zone 120' is located over each of the two pouring spout tips, and reduces or prevents functional impairment of both during sealing. Such sealing would, of course, require sealing jaws having a plurality of spaced recesses.

Figure 7:
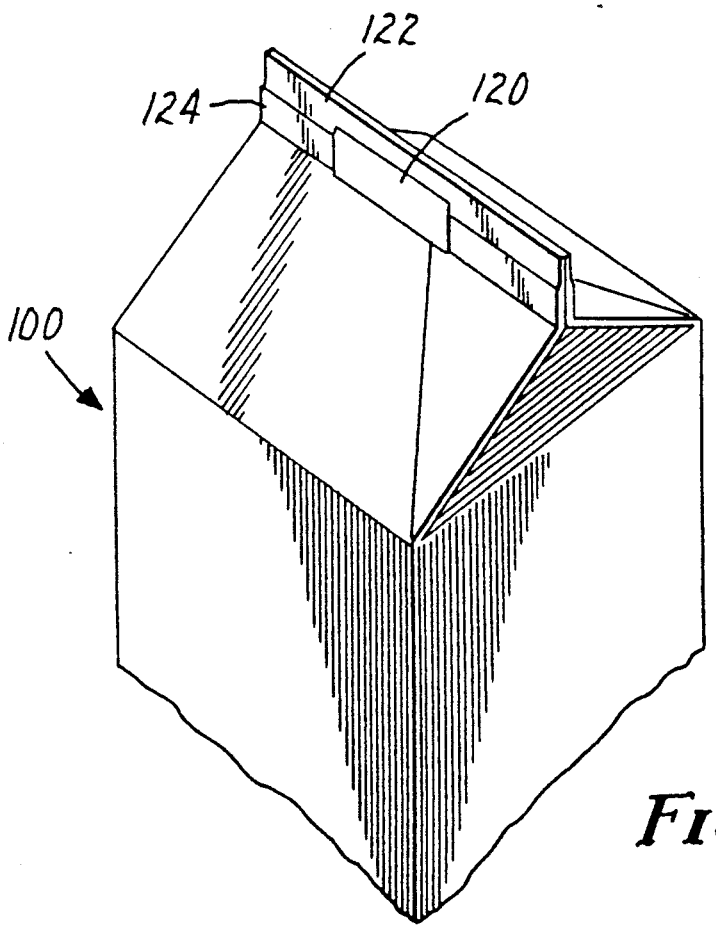
FIG. 7 is a perspective view of the carton of the present invention after the sealing process.

FIG. 7 illustrates a gable-top container 100 sealed using the method of the present invention. Medial zone 120 extends partially into upper rib area 122, but the height of the recess in the sealing jaw could be adjusted to limit medial zone 120 to roof rib area 124.

The present invention has now been described with reference to several embodiments thereof. It will be apparent to those skilled in the art that many changes can be made in the embodiments described without departing from the scope of the invention. Thus, the scope of the present invention should not be limited to the structures described in this application, but only by structures described by the language of the following claims, and the equivalents of those structures.

What is claimed is:

1. A method for producing a gable-top container, comprising the steps of:

a) providing a container blank adapted to form the gable-top container having an inner and an outer surface, said inner surface having a thermoplastic coating, said container having at least one wall having a lower edge and an upper edge;

a bottom connected to said lower edge;

at least one set of pouring spout panels comprising a first generally triangular end panel connected to said upper edge, first and second foldback panels connected to first and second lateral edges of said first generally triangular end panel, and first and second roof wing panels connected to first and second lateral edges of said first and second foldback panels and connected to said upper edge, which pouring spout panels cooperate to form a pouring spout, said pouring spout shiftable between a retracted position and an extended position, said extended position enabling dispensation of the contents of the container;

first and second roof panels, said first roof panel connected to an uppermost edge of said at least one side panel and adjoining said first roof wing panel along one lateral edge thereof, said second roof panel connected to an uppermost edge of said container top and adjoining said second roof wing panel along one lateral edge thereof;

first and second gable rib panels, said first gable rib panel connected to an upper edge of said first foldback panel, said second gable rib panel connected to an upper edge of said second foldback panel, a common scoreline between said first and second gable rib panels directly above a peak of said generally triangular end panel forming a pouring spout tip;

first and second roof rib panels, said first roof rib panel connected to said first roof panel and said first roof wing panel, said second roof rib panel connected to said second roof panel and said second roof wing panel, said first and second roof rib panels adapted to seal against said first and second gable rib panels located therebetween when said pouring spout is in said retracted position;

first and second upper rib panels, said first upper rib panel connected to the uppermost edge of said first roof rib panel and extending upwardly therefrom, said second upper rib panel connected to the uppermost edge of said second roof rib panel and extending upwardly therefrom, said upper rib panels adapted for reciprocal bonding to seal the container;

(b) forming the gable-top container from said container blank, said pouring spout tip being interposed between said first and second roof rib panels when said pouring spout is in said retracted position;

(c) heating at least the inner surface of said roof rib panels and said upper rib panels to a temperature sufficient for sealing the thermoplastic coating on facing surfaces of the container;

(d) applying a first sealing pressure to said upper rib panels and to first portions of said roof rib panels to seal the container; and (e) applying a second sealing pressure to second portions of said roof rib panels overlying said pouring spout tip to seal said inner surfaces of said second portions of said roof rib panels against said gable rib panels located therebetween, whereby said first and second sealing pressures present said upper rib panels and said roof rib panels for mutual contact while heated so as to permit reciprocal bonding thereof to seal the container without functionally impairing said pouring spout tip.

2. The method of claim 1, wherein said at least one set of pouring spout panels comprises two sets of pouring spout panels, said first set of pouring spout panels cooperating to form a first pouring spout, said second set of pouring spout panels cooperating to form a second pouring spout, said first and second pouring spouts maintained in opposed relationship when said pouring spouts are in said retracted position.

3. The method of claim 1, wherein steps (d) and (e) comprise:

providing a pair of sealing jaws including opposed sealing surfaces for compressive contact with exterior surfaces of said upper rib panels and said roof rib panels;

forming in said sealing jaws at least one recess in at least one of said sealing surfaces for providing a second pressure to said second portions of said roof rib panels overlying said pouring spout tip;

providing means for cooperative movement of said sealing jaws between positions spaced from the container and sealing positions in contact with the exterior of said first and second upper rib panels;

compressing said upper rib panels and said roof rib panels with said sealing jaws so as to permit reciprocal bonding thereof to seal the container without functionally impairing said pouring spout tip.

4. A gable-top container made by the process of:

a) providing a container blank adapted to form the gable-top container having an inner and an outer surface, said inner surface having a thermoplastic coating, said container having at least one wall having a lower edge and an upper edge;

a bottom connected to said lower edge;

at least one set of pouring spout panels comprising a first generally triangular end panel connected to said upper edge, first and second foldback panels connected to first and second lateral edges of said first generally triangular end panel, and first and second roof wing panels connected to first and second lateral edges of said first and second foldback panels and to said upper edge, which pouring spout panels cooperate to form a pouring spout, said pouring spout shiftable between a retracted position and an extended position, said extended position enabling dispensation of the contents of the container;

first and second roof panels, said first roof panel connected to an uppermost edge of said at least one side panel and adjoining said first roof wing panel along one lateral edge thereof, said second roof panel connected to an uppermost edge of said container top and adjoining said second roof wing panel along one lateral edge thereof;

first and second gable rib panels, said first gable rib panel connected to an upper edge of said first foldback panel, said second gable rib panel connected to an upper edge of said second foldback panel, a common scoreline between said first and second gable rib panels directly above a peak of said generally triangular end panel forming a pouring spout tip;

first and second roof rib panels, said first roof rib panel connected to said first roof panel and said first roof wing panel, said second roof rib panel connected to said second roof panel and said second roof wing panel, said first and second roof rib panels adapted to seal against said first and second gable rib panels located therebetween when said pouring spout is in said retracted position;

first and second upper rib panels, said first upper rib panel connected to the uppermost edge of said first roof rib panel and extending upwardly therefrom, said second upper rib panel connected to the uppermost edge of said second roof rib panel and extending upwardly therefrom, said upper rib panels adapted for reciprocal bonding to seal the container;

(b) forming the gable-top container from said container blank, said pouring spout tip being interposed between said first and second roof rib panels when said pouring spout is in said retracted position;

(c) heating the panels at least the inner surface of said roof rib panels and said upper rib panels to a temperature sufficient for sealing the thermoplastic coating on facing surfaces of the container;

(d) applying a first sealing pressure to said upper rib panels and to first portions of said roof rib panels to seal the container; and (e) applying a second sealing pressure to second portions of said roof rib panels overlying said pouring spout tip to seal said inner surfaces of said second portions of said roof rib panels against said gable rib panels located therebetween, whereby said first and second sealing pressures present said upper rib panels and said roof rib panels for mutual contact while heated so as to permit reciprocal bonding thereof to seal the container without functionally impairing said pouring spout tip.

* * * * *